US012613055B2

(12) United States Patent
Nagahama

(10) Patent No.: US 12,613,055 B2
(45) Date of Patent: Apr. 28, 2026

(54) HOT WATER SUPPLY APPARATUS

(71) Applicant: RINNAI CORPORATION, Aichi (JP)

(72) Inventor: Chihiro Nagahama, Aichi (JP)

(73) Assignee: Rinnai Corporation, Aichi (JP)

( * ) Notice: Subject to any disclaimer, the term of this patent is extended or adjusted under 35 U.S.C. 154(b) by 403 days.

(21) Appl. No.: 18/541,578

(22) Filed: Dec. 15, 2023

(65) Prior Publication Data

US 2024/0280294 A1 Aug. 22, 2024

(30) Foreign Application Priority Data

Feb. 20, 2023 (JP) ..... 2023-024089

(51) Int. Cl.

| | |
|---|---|
| ***F24H 15/36*** | (2022.01) |
| ***F24H 15/215*** | (2022.01) |
| ***F24H 15/219*** | (2022.01) |
| ***F24H 15/33*** | (2022.01) |

(52) U.S. Cl.

CPC ..... *F24H 15/215* (2022.01); *F24H 15/219* (2022.01); *F24H 15/33* (2022.01)

(58) Field of Classification Search

CPC ..... F24H 15/215; F24H 15/219; F24H 15/31; F24H 15/36; F23N 1/04; F23N 5/12

See application file for complete search history.

(56) References Cited

U.S. PATENT DOCUMENTS

| | | | | |
|---|---|---|---|---|
| 9,063,551 | B2 * | 6/2015 | Deivasigamani | F24H 15/395 |
| 11,313,589 | B2 * | 4/2022 | Yuge | F24H 15/325 |

FOREIGN PATENT DOCUMENTS

| | | | | |
|---|---|---|---|---|
| GB | 2489017 | A * | 9/2012 | G05D 23/1951 |
| JP | 2013-204897 | A | 10/2013 | |
| JP | 2021-179281 | A | 11/2021 | |
| JP | 7328876 | B2 * | 8/2023 | |

* cited by examiner

*Primary Examiner* — Gregory A Wilson

(74) *Attorney, Agent, or Firm* — Future IP LLC; Tomoko Nakajima

(57) ABSTRACT

In a hot water supply apparatus including a heat exchanger to which water heated by renewable energy or waste heat from other heat sources is supplied, a controller performs an intermittent combustion control in which combustion and combustion stoppage in a burner are repeated as a condition in which a water supply temperature exceeds a predetermined upper limit of the water supply temperature. In the intermittent combustion control, a combustion fan is caused to operate during the combustion and to at least temporarily, preferably always, operate during the combustion stoppage.

5 Claims, 3 Drawing Sheets

HOT WATER SUPPLY APPARATUS

TECHNICAL FIELD

The invention relates to a hot water supply apparatus which includes a burner, a combustion fan which supplies air for combustion to the burner, a heat exchanger which is heated by a combustion gas generated by combustion of the burner to supply hot water, a water supply temperature sensor which detects a water supply temperature which is a temperature of water supplied to the heat exchanger, and a controller.

BACKGROUND ART

In the hot water supply apparatus of this kind, need to supply water heated by renewable energy or waste heat from other heat sources to the heat exchanger has increased. Here, if the water supply temperature to the heat exchanger becomes too high, an atmospheric temperature in the hot water supply apparatus will rise, and temperatures of such as the heat exchanger and other components in the hot water supply apparatus will exceed heat-resistant temperatures, sometimes resulting in reduced durability. Then, conventionally, there has been known the hot water supply apparatus which performs a control which stops the combustion of the burner when the water supply temperature detected by the water supply temperature sensor exceeds a predetermined upper limit of the water supply temperature (Patent document No. 1, for example).

In addition, conventionally, there has been known another hot water supply apparatus which includes a premixing apparatus which mixes a fuel gas with air for the combustion and supplies an air-fuel mixture to the burner through the combustion fan (Patent document No. 2, for example). The premixing apparatus includes an air supply passage of an upstream side of the combustion fan, a gas supply passage which supplies the fuel gas and a downstream end of which is connected to a gas suction portion provided with the air supply passage, a master valve, a zero governor regulating a secondary gas pressure to an atmospheric pressure, and a variable throttle valve, which are sequentially interposed into the gas supply passage from an upstream side, and a butterfly valve interposed into a portion of the air supply passage of an upstream side of the gas suction portion. The controller is configured to perform a control in which a combustion capacity is switched to a small capacity by making an opening degree of the butterfly valve a predetermined small capacity opening degree of a closed side, and by making an opening degree of the variable throttle valve a predetermined small capacity opening degree, and a control in which the combustion capacity is switched to a large capacity by making the opening degree of the butterfly valve a predetermined large capacity opening degree of an opened side, and by making the opening degree of the variable throttle valve a predetermined large capacity opening degree larger than the small capacity opening degree. In such hot water supply apparatus, when the water supply temperature exceeds an upper limit of the water supply temperature, the required combustion amount necessary to make the water supply temperature a predetermined water supply set temperature decreases and the combustion capacity is switched to the small capacity. In the small capacity, since the butterfly valve is caused to become the small capacity opening degree, the amount of air decreases and the temperatures of the components are more likely to rise. Accordingly, by applying the technology disclosed in Patent document No. 1 to the hot water supply apparatus disclosed in Patent document No. 2, it is considered that the combustion of the burner is caused to stop when the water supply temperature exceeds the upper limit of the water supply temperature.

However, if the combustion of the burner is caused to stop when the water supply temperature exceeds the upper limit of the water supply temperature, an opportunity that hot water of which a temperature is higher than the upper limit of the water supply temperature cannot be supplied will increase and convenience will be lost.

REFERENCE

Patent document No. 1: JP2013-204897 A
Patent document No. 2: JP2021-179281 A

SUMMARY OF INVENTION

Technical Problem

In the light of the above problem, the invention provides a hot water supply apparatus of which the convenience is improved by making it possible to supply the hot water of which the temperature is higher than the upper limit of the water supply temperature even when the water supply temperature exceeds the upper limit of the water supply temperature, and of which the durability is also caused not to deteriorate.

Solution to Problem

In order to solve the above problem, the invention presupposes a hot water supply apparatus which includes a burner, a combustion fan which supplies air for combustion to the burner, a heat exchanger which is heated by a combustion gas generated by combustion of the burner to supply hot water, a water supply temperature sensor which detects a water supply temperature which is a temperature of water supplied to the heat exchanger, and a controller. In the hot water supply apparatus, the controller is configured to perform an intermittent combustion control which causes the combustion and combustion stoppage of the burner to be repeated as a condition in which the water supply temperature detected by the water supply temperature sensor exceeds a predetermined upper limit of the water supply temperature during a hot water supply operation in which the water is caused to flow in the heat exchanger, wherein the intermittent combustion control causes the combustion fan to operate not only during the combustion, but also at least temporarily during the combustion stoppage.

In the invention, since when the water supply temperature exceeds the upper limit of the water supply temperature, the combustion is not caused to stop, but the intermittent combustion control is performed, hot water of which a temperature is higher than the upper limit of the water supply temperature can be supplied, thereby improving convenience. Further, in the intermittent combustion control, since the combustion fan is also caused to operate during the combustion stoppage, components in the hot water supply apparatus are cooled by air flows generated by the operation of the combustion fan.

As a result, it can be suppressed that component temperatures in the hot water supply apparatus exceeds the heat-resistant temperature and durability is reduced.

Meanwhile, in the invention, it is desirable to cause the combustion fan to always operate during the combustion stoppage in the intermittent combustion control. According to this, components in the hot water supply apparatus can be effectively cooled.

Incidentally, even in the case where high temperature water is supplied to the water supply passage to the heat exchanger, the temperature of each of the components does not become high immediately. Accordingly, it is not necessary to cause the intermittent combustion control to be performed immediately when the water supply temperature exceeds the upper limit of the water supply temperature. Here, the hot water apparatus generally includes a hot water supply temperature sensor that detects a hot water supply temperature, which is a temperature of the water supplied to a hot water supply terminal at a downstream end of a hot water supply passage connected to a downstream side of the heat exchanger. In addition, the component temperature becomes higher when the water supply temperature exceeds the upper limit of the water supply temperature, and when the hot water supply temperature becomes a predetermined temperature or higher which is higher than the upper limit of the water supply temperature and is lower than a hot water supply set temperature, and when a required combustion amount which is necessary to make the hot water supply temperature the hot water supply set temperature becomes a predetermined value or lower, and also when the amount of air which also contributes to cooling the components is decreased by decrease of a rotational speed of the combustion fan. Therefore, in the invention, it is desirable that the controller is configured to perform the intermittent combustion control during the hot water supply operation when the condition in which the water supply temperature exceeds the upper limit of the water supply temperature is satisfied, and, in addition, when a condition in which the hot water supply temperature detected by the hot water temperature sensor is a predetermined temperature or higher and the required combustion amount is a predetermined value or lower is satisfied. According to this, the performance of the intermittent combustion control more than necessary can be prevented.

In addition, in the invention, it may be possible for the controller to be configured to perform the intermittent control during the hot water operation when a condition in which a predetermined time elapses from start of the hot water supply operation, in addition to the condition in which the water supply temperature exceeds the upper limit of the water supply temperature. This can also prevent the intermittent combustion control from being performed more than necessary.

Further, in a case where the hot water supply apparatus includes the above-mentioned premixing apparatus, since the combustion capacity is switched to the small capacity when the water supply temperature exceeds the upper limit of the water supply temperature, the intermittent combustion control is performed in a state where the combustion capacity has been switched to the small capacity. Then, during the combustion stoppage in the intermittent control, it is desirable to make the opening degree of the butterfly valve the large capacity opening degree and operate the combustion fan. According to this, the amount of air flowing due to the operation of the combustion fan during the combustion stoppage is increased and the components can be cooled effectively.

DESCRIPTION OF EMBODIMENTS

Figure 1:
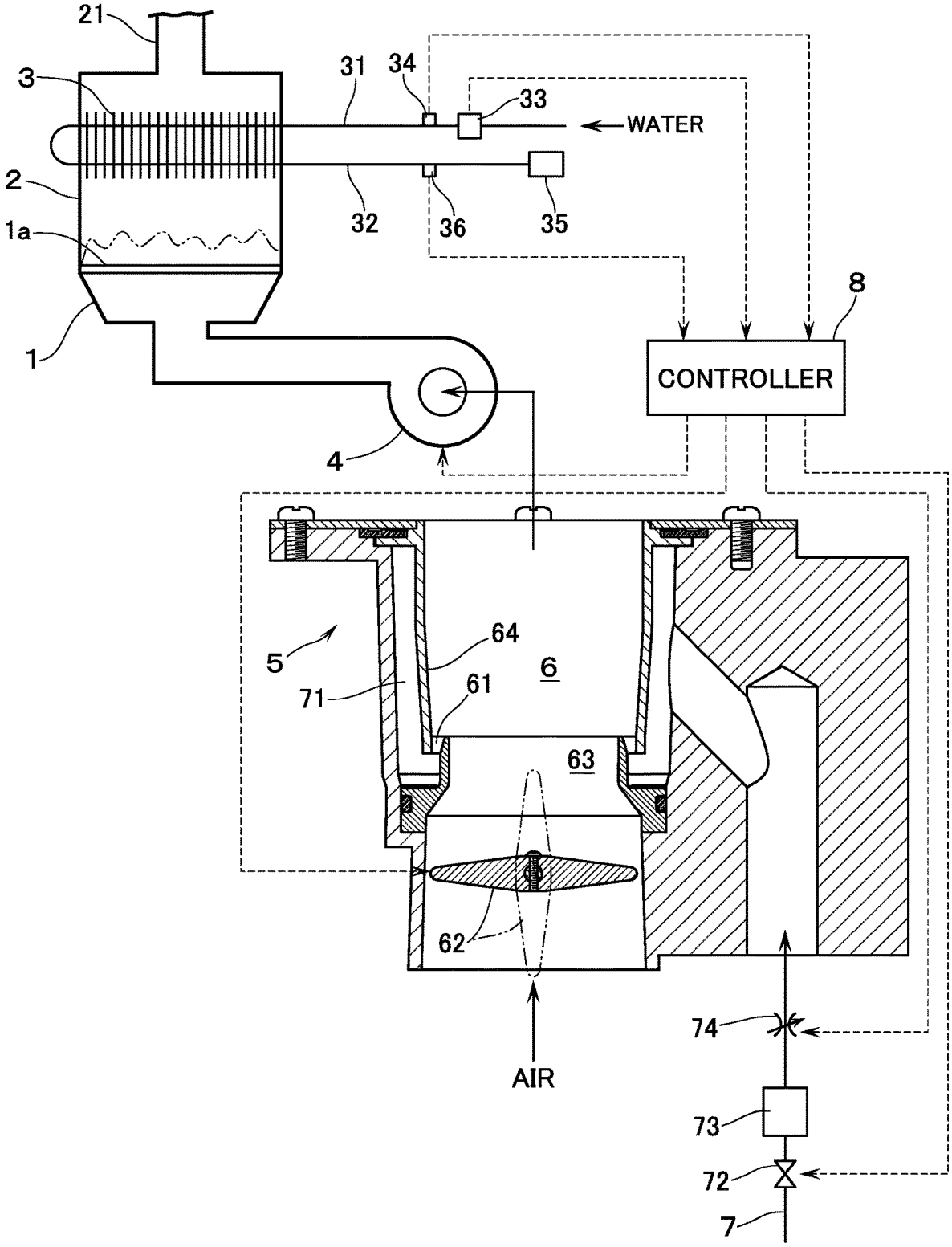
FIG. 1 is an explanatory view showing a hot water supply apparatus of an embodiment of the invention.

A hot water supply apparatus of an embodiment of the invention, which is shown in FIG. 1, includes a burner 1 of a totally primary combustion manner, a combustion box 2 surrounding a combustion space of an air-fuel mixture ejecting from a combustion surface 1*a* of the burner 1, a heat exchanger 3 disposed in the combustion box 2, and a combustion fan 4 supplying air for combustion to the burner 1. A combustion gas generated by combustion of the burner 1, i.e., the combustion of the air-fuel mixture ejecting from the combustion surface 1*a* is exhausted to an outside through an exhaust tube 21 connected to an end portion of the combustion box 2 after heating the heat exchanger 3. A water supply passage 31 and a hot water supply passage 32 are connected to upstream and downstream sides of the heat exchanger 3, respectively. A water amount sensor 33, and a water supply temperature sensor 34 detecting a water supply temperature which is a temperature of water supplied to the heat exchanger 3 are provided with the water supply passage 31, and a hot water supply temperature sensor 36 detecting a hot water supply temperature which is a temperature of water supplied to a hot water supply terminal 35 at a downstream end of the hot water supply passage 32 is provided with the hot water supply passage 32.

In addition, the hot water supply apparatus of the embodiment includes a premixing apparatus 5 which mixes a fuel gas with the air for combustion and supplies an air-fuel mixture to the burner 1 through the combustion fan 4. The premixing apparatus 5 includes an air supply passage 6 of an upstream side of the combustion fan 4 and a gas supply passage 7 which supplies the fuel gas. Meanwhile, air flows in the air supply passage 6 through a space in a housing of the hot water supply apparatus, not shown, in which the combustion box 2, the premixing apparatus 5, or the like are stored.

A downstream end of the gas supply passage 7 is connected to a gas suction portion 61 provided with the air supply passage 6. A venturi portion 63 of which a diameter is smaller than that of a portion at which a butterfly valve 62 mentioned below is disposed, is provided with a portion of the air supply passage 6, which is adjacent at an upstream side of the gas suction portion 61. A portion of the air supply passage 6 adjacent at a downstream side of the venturi portion 63 is surrounded by a cylindrical portion 64 of which a diameter is larger than that of the venturi portion 63. A downstream end portion of the venturi portion 63 is inserted into an upstream end portion of the cylindrical portion 64 with an annular clearance, and the gas suction portion 61 is configured by the clearance. A gas chamber 71 communicating with the gas suction portion 61 and surrounding the cylindrical portion 64 is provided at the downstream end of the gas supply passage 7. A master valve 72, a zero governor 73 which regulates a secondary gas pressure to an atmospheric pressure, and a variable throttle valve 74 are sequentially interposed into the gas supply passage 7 from an upstream side thereof.

The amount of the fuel gas supplied through the gas suction portion 61 changes corresponding to a differential pressure between the atmospheric pressure, which is the secondary gas pressure, and a negative pressure in the air supply passage 6. Here, the negative pressure in the air supply passage 6 changes corresponding to a rotational speed of the combustion fan 4. Therefore, the amount of the fuel gas changes in proportion to the rotational speed of the combustion fan 4, i.e., the supply amount of the air. In addition, a ratio of the supply amount of the fuel gas and the supply amount of air changes corresponding to an opening degree of the variable throttle valve 74. The opening degree of the variable throttle valve 74 is made to a predetermined standard opening degree corresponding to a type of the fuel gas used, thereby making an excess air ratio of the air-fuel mixture a predetermined appropriate value (e.g., 1.3). A controller 8 consisting of a microcomputer controls the rotational speed of the combustion fan 4 corresponding to a required combustion amount necessary to make the hot water supply temperature a prescribed hot water supply set temperature (calculated from the water supply amount detected by the water amount sensor 33, the water supply temperature detected by the water supply temperature sensor 34, and the hot water supply set temperature) so as to supply the air-fuel mixture, of which the excess air ratio is the appropriate value and of which the amount corresponds to the required combustion amount, to the burner 1.

Meanwhile, in order to prevent occurrence of an exhaust failure due to a wind intrusion, i.e., to ensure wind resistance performance, a lower limit of the rotational speed of the combustion fan 4 cannot be set too slow. Therefore, in a case where the required combustion amount becomes a predetermined threshold corresponding to the lower limit of the rotational speed of the combustion fan 4 or slower, air in the amount corresponding to the required combustion amount cannot be supplied.

Accordingly, in order for ventilation resistance to switch two levels of ventilation resistance of a portion of the air supply passage 6 positioned at an upstream side from the gas suction portion 61, the butterfly valve 62, which is switched to a closed posture indicated by a solid line and an opened posture indicated by a virtual line in FIG. 1 by a motor, not shown, is disposed at the portion of the air supply passage 6 positioned at the upstream side from the gas suction portion 61. Then, in the case where the required combustion amount becomes the above-mentioned threshold or less, the butterfly valve 62 is switched to the closed posture by the controller 8, thereby increasing the ventilation resistance of the air supply passage 6 so as to supply air in the amount corresponding to the required combustion amount of the threshold or less without reducing the rotational speed of the combustion fan 4 below the lower limit of the rotational speed.

However, when the butterfly valve 62 is switched to the closed posture, thereby simply increasing the ventilation resistance of the air supply passage 6, a negative pressure in the air supply passage 6 increases, the supply amount of the fuel gas becomes excessive, and the excess air ratio of the air-fuel mixture supplied to the burner 1 becomes less than the appropriate value. Therefore, in the case where the required combustion amount is the threshold value or less, the combustion capacity is switched to the small capacity not only by switching the opening degree of the butterfly valve 62 to the predetermined small capacity opening degree which is an opening degree at the closed posture, but also by making the opening degree of the variable throttle valve 74 the predetermined small capacity opening degree which is smaller than the standard opening degree, and the air-fuel mixture of which the excess air ratio is the appropriate value and of which the amount corresponds to the required combustion amount of the threshold or less is supplied to the burner 1. In addition, in the case where the required combustion amount exceeds the threshold, the combustion capacity is switched to the large capacity not only by switching the opening degree of the butterfly valve 62 to the predetermined large capacity opening degree which is an opening degree at the opened posture, but also by making the opening degree of the variable throttle valve 74 the predetermined large capacity opening degree as the standard opening degree, and the air-fuel mixture of which the excess air ratio is the appropriate value and of which the amount corresponds to the required combustion amount exceeding the threshold is supplied to the burner 1.

Further, in the hot water supply apparatus of the embodiment, water heated by renewable energy or waste heat from other heat sources is supplied to the heat exchanger 3 through the water supply passage 31. In addition, a dishwasher is applied to the hot water terminal 35, for example, and the hot water supply set temperature is very high, e.g., 85° C. In such hot water supply apparatus, when the water supply temperature becomes 40° C. or higher, an atmospheric temperature in the hot water supply apparatus rises, temperatures of components such as the heat exchanger 3 and the combustion box 2 exceed a heat-resistant temperature, and durability is sometimes reduced.

Figure 2:
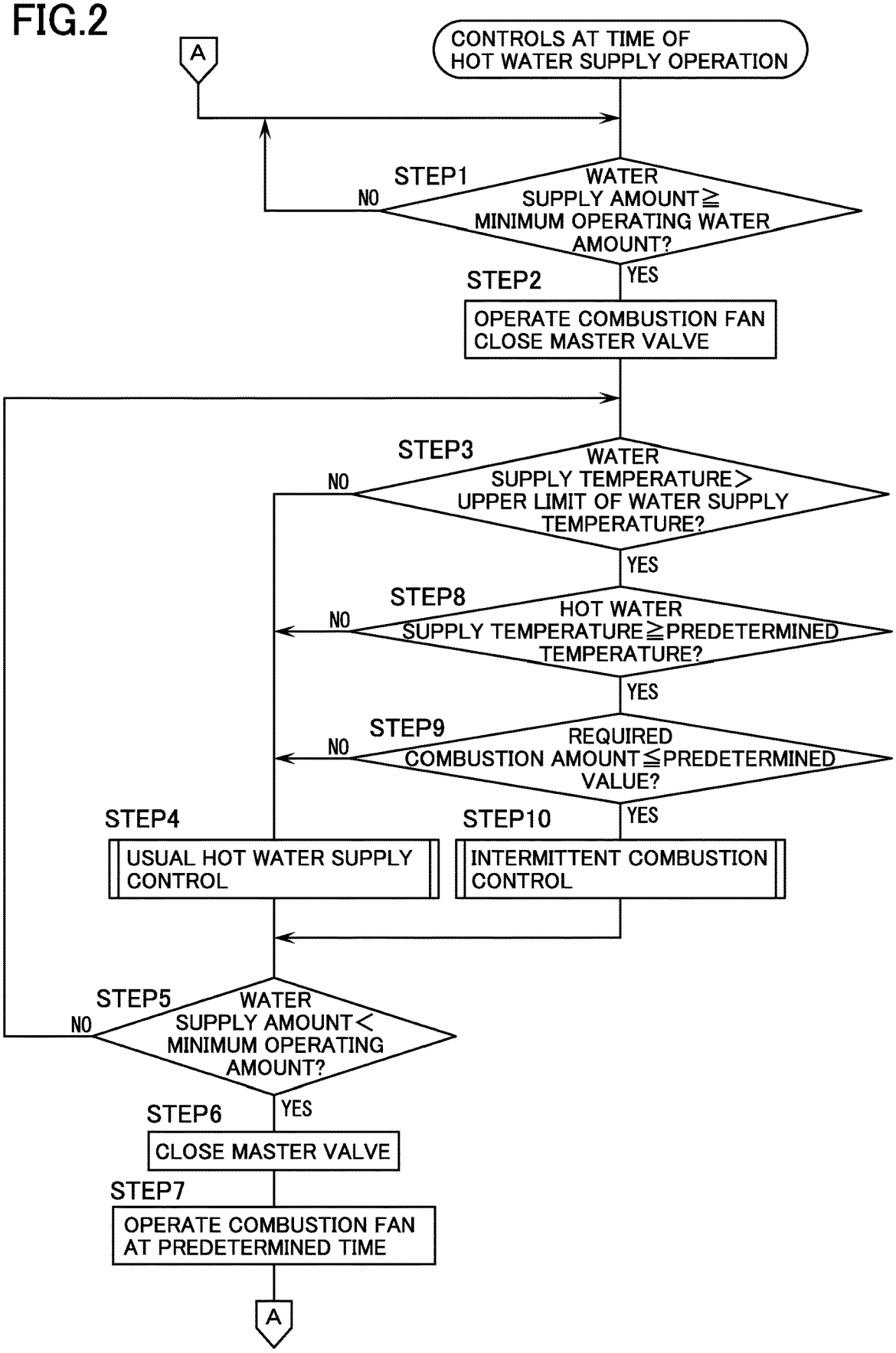
FIG. 2 is a flow chart showing contents of controls during a hot water supply operation, which a controller provided with the hot water supply apparatus of the embodiment performs.

Accordingly, in the hot water supply apparatus of the embodiment, the controller 8 performs an intermittent combustion control which repeats combustion and combustion stoppage of the burner 1 as a condition in which the water supply temperature detected by the water supply temperature sensor 34 exceeds a predetermined upper limit of the water supply temperature (for example, 40° C.) during a hot water supply operation in which water is supplied to the heat exchanger 3. In the intermittent control, the combustion fan 4 is made to operate not only during the combustion, but also during the combustion stoppage. Now, controls at the time of the hot water supply operation will be described in detail below with reference to FIG. 2:

In the controls, first, in STEP 1, discrimination of whether the water supply amount detected by the water amount sensor 33 becomes a minimum operating water amount or more is performed, and at the time of the minimum operating water amount or more, in STEP 2, the combustion fan 4 is caused to operate and the master valve 72 is caused to open, thereby igniting the burner 1 and starting the hot water supply operation. Next, in STEP 3, discrimination of whether the water supply temperature detected by the water supply temperature sensor 34 exceeds the upper limit of the water supply temperature is performed. If the water supply temperature is the upper limit of the water supply temperature or lower, in STEP 4, a usual control is performed by switching the combustion capacity and controlling the rotational speed of the combustion fan 4 so that the amount of the combustion of the burner 1 becomes the required combustion amount necessary for the hot water temperature to be the predetermined hot water supply set temperature (for example, 85° C.). Thereafter, in STEP 5, discrimination of whether the water supply amount detected by the water amount sensor 33 becomes less than the minimum operating water amount. If the water supply amount is the minimum operating water amount or more, the controls return to STEP 3. Meanwhile, if the water supply amount is less than the minimum operating water amount, in STEP 6, the master valve 72 is caused to close and the burner 1 is caused to extinguish, in addition, a post-purge in which the combustion fan 4 is caused to continue operating at a constant time after extinguishing is performed in STEP 7, and then the controls return to STEP 1.

When the water supply temperature is discriminated to exceed the upper limit of the water supply temperature in STEP 3, in STEP 8, discrimination of whether the hot water supply temperature detected by the hot water supply temperature sensor 36 becomes a predetermined temperature (for example, 63° C.) between the upper limit of the water supply temperature and the hot water supply set temperature is performed. If the hot water supply temperature is the predetermined temperature or higher, in STEP 9, discrimination of whether the required combustion amount is the predetermined value or less. When the hot water supply temperature is lower than the predetermined temperature or the required combustion amount exceeds the predetermined value, in STEP 4, the usual hot water supply control is performed. Meanwhile, if the hot water supply temperature is the predetermined temperature or higher and the required combustion amount is the predetermined value or less, in STEP 10, the intermittent combustion control which causes the combustion and the combustion stoppage of the burner 1 to be repeated is performed. The intermittent combustion control causes the combustion fan 4 to be operate not only during the combustion but also during the combustion stoppage.

According to the above controls, when the water supply temperature exceeds the upper limit of the water supply temperature, since the combustion is not stopped but the intermittent combustion control is performed, the hot water of which the temperature is higher than the upper limit of the water supply temperature can be supplied, thereby improving convenience. Further, in the intermittent control, since the combustion fan 4 is caused to operate during the combustion stoppage, the components such as the combustion box 2 and the heat exchanger 3 in the hot water supply apparatus are cooled by air flows generated by the operation of the combustion fan 4. As a result, reduction of durability caused by the component temperatures in the hot water supply apparatus exceeding the heat-resistant temperature can be suppressed.

In this connection, even when high-temperature water is supplied to the water supply passage 31 to the heat exchanger 3, the component temperatures are not immediately high.

Accordingly, it is not necessary to cause the intermittent combustion control to be performed immediately when the water supply temperature exceeds the upper limit of the water supply temperature. Here, the component temperatures become high when the water supply temperature exceeds the upper limit of the water supply temperature, and when the hot water supply temperature becomes the above-mentioned predetermined temperature or higher, and also when the amount of the air which also contributes to cooling the components is decreased by decrease of the required combustion amount. According to the controls of the embodiment, at the time of the hot water supply operation, when the condition in which the hot water temperature is the predetermined temperature or higher and the required combustion amount is the predetermined value or less, in addition to the condition in which the water supply temperature exceeds the upper limit of the water supply temperature, are satisfied, the intermittent combustion control is performed. Therefore, the performance of the intermittent combustion control more than necessary can be prevented.

Figure 3:
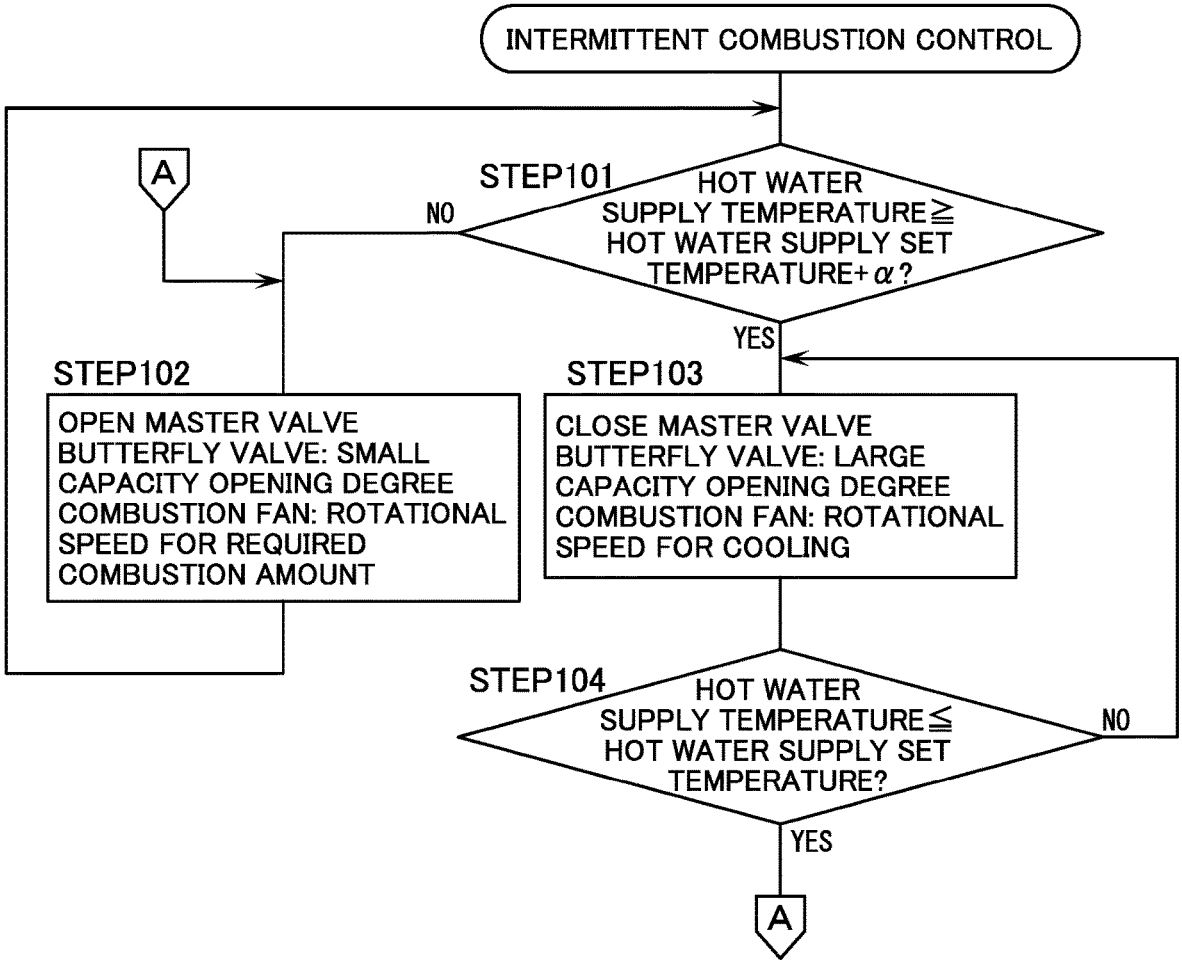
FIG. 3 is a flow chart showing contents of an intermittent control of STEP 10 of FIG. 2.

Incidentally, in the case where the water supply temperature exceeds the upper limit of the water supply temperature, the required combustion amount becomes the minimum combustion amount or less of the large capacity and the combustion capacity is switched to the small capacity. Accordingly, the intermittent combustion control is performed in the state where the combustion capacity is switched to the small capacity. In addition, the above-mentioned predetermined value used in the discrimination in STEP 9 is set to a combustion amount of an intermediate range in the small capacity or the combustion amount slightly smaller than that of the intermediate range. The intermittent combustion control is performed as shown in FIG. 3.

Namely, in the intermittent combustion control, first, in STEP 101, discrimination of whether the hot water supply temperature detected by the hot water supply temperature sensor 36 becomes the hot water supply set temperature+α (for example, 2° C.) or higher is performed. In a case where the hot water supply temperature is lower than the hot water supply set temperature+a, in STEP 102, the master valve 72 is kept in the opened state and the butterfly valve 62 is kept in the small capacity opening degree, the combustion fan 4 is caused to rotate at a rotational speed corresponding to the required combustion amount, in other words, the combustion of the burner 1 is performed so that the combustion amount in the small capacity becomes the required combustion amount, and return to STEP 101 is caused to be repeated.

Even though the combustion of the burner 1 is performed in the required combustion amount, the hot water supply temperature temporarily becomes the hot water supply set temperature+α or higher due to hot water temperature wobble. At this time, in STEP 103 following STEP 101, the combustion of the burner 1 is stopped by causing the master valve 72 to close, and the combustion fan 4 is caused to rotate at a predetermined cooling rotational speed equal to or faster than the rotational speed corresponding to the required combustion amount (for example, 1 to 4 times the rotational speed corresponding to the required combustion amount) by switching the butterfly valve 62 to the large capacity opening degree. According to this, the amount of air flowing due to the operation of the combustion fan 4 becomes more than that in a case where the butterfly valve 62 is kept at the small capacity opening degree, allowing the components in the hot water supply apparatus to cool effectively.

Next, in STEP 104, discrimination of whether the hot water temperature detected by the hot water supply temperature sensor 36 becomes the hot water supply set temperature or lower is performed. Then, the return to STEP 3 is repeated until the hot water supply temperature becomes the hot water supply set temperature, and when the hot water supply temperature becomes the hot water supply set temperature or lower, in STEP 102, the combustion of the burner 1 is caused to restart so that the combustion amount in the small capacity becomes the required combustion amount.

Meanwhile, discriminant processing of whether a predetermined time (for example, 15 minutes) elapses from starting the hot water supply operation is performed instead of the above-mentioned discriminant processing of STEPS 8, 9, and the controls may proceed to STEP 4 until the predetermined time elapses and may proceed to STEP 10 when the predetermined time elapses. Namely, the intermittent combustion control may be performed when, at the time of the hot water supply operation, the condition in which the water supply temperature exceeds the upper limit of the water supply temperature is satisfied, and, in addition, a condition of the elapse of the predetermined time from starting the hot water supply operation is satisfied. In this case, the performance of the intermittent combustion control more than necessary can be also prevented.

Though the embodiment of the invention is explained with reference to the drawings, the invention is not limited to the embodiment. For example, in the above-mentioned embodiment, though the combustion is caused to stop when the hot water supply temperature becomes the hot water supply set temperature+α or higher and the combustion is caused to restart when the hot water supply temperature becomes the hot water supply set temperature or lower in the intermittent combustion control, time for causing the combustion and time for stopping the combustion are set in advance, and it is possible to cause the combustion and the combustion stoppage to be repeated. In addition, in the above-mentioned embodiment, though the combustion fan 4 is always caused to operate during the combustion stoppage in the intermittent control, the combustion fan 4 may be caused to operate temporarily during the combustion stoppage. However, it is advantageous for the combustion fan 4 to always operate during the combustion stoppage because it provides effective cooling of the components.

Further, during the combustion in the intermittent control, though the butterfly valve 62 is caused to switch to the small capacity opening degree and the variable throttle valve 74 is also caused to switch to the small opening degree so that the excess air ratio of the air-fuel mixture becomes the appropriate value, it is possible to cause the excess air ratio to increase larger than the appropriate value while maintaining the combustion amount at the required amount by reducing the opening degree of the variable throttle valve 74 smaller than the small capacity opening degree and increasing the rotational speed of the combustion fan 4 faster than that corresponding to the required combustion amount. Furthermore, in the above-mentioned embodiment, though the invention is applied to the hot water supply apparatus including the premixing apparatus 5 which supplies the air-fuel mixture to the totally primary combustion burner 1 through the combustion fan 4, the invention can also be applied to a hot water supply apparatus which does not include the premixing apparatus and in which primary and secondary air for the combustion are supplied to the Bunsen burner by the combustion fan.

Meanwhile, it can also be considered that a fan for cooling is provided in a housing of the hot water supply apparatus, and when the water supply temperature exceeds the upper limit of the water supply temperature, the components are cooled by causing the fan for cooling to operate without performing the above-mentioned intermittent control. However, this requires the fan for cooling other than the combustion fan 4, so the invention which does not require the fan for cooling is more cost-effective.

| Explanation of symbols | |
|---|---|
| 1 | Burner |
| 3 | Heat exchanger |
| 32 | Hot water supply passage |
| 34 | Water supply temperature sensor |
| 35 | Hot water supply terminal |
| 36 | Hot water supply temperature sensor |
| 4 | Combustion fan |
| 5 | Premixing apparatus |
| 6 | Air supply passage |
| 61 | Gas suction portion |
| 62 | Butterfly valve |
| 7 | Gas supply passage |
| 72 | Master valve |
| 73 | Zero governor |

-continued

| Explanation of symbols | |
|---|---|
| 74 | Variable throttle valve |
| 8 | Controller |

What is claimed is:

1. A hot water supply apparatus, comprising, a burner;

a combustion fan which supplies air for combustion to the burner;

a heat exchanger which is heated by a combustion gas generated by combustion of the burner to supply hot water;

a water supply temperature sensor which detects a water supply temperature which is a temperature of water supplied to the heat exchanger; and a controller wherein the controller is configured to perform an intermittent combustion control which causes the combustion and combustion stoppage of the burner to be repeated as a condition in which the water supply temperature detected by the water supply temperature sensor exceeds a predetermined upper limit of the water supply temperature during a hot water supply operation in which the water is caused to flow in the heat exchanger, and wherein the intermittent combustion control causes the combustion fan to operate not only during the combustion, but also at least temporarily during the combustion stoppage.

2. The hot water supply apparatus as claimed in claim 1, wherein the combustion fan is caused to always operate during the combustion stoppage in the intermittent combustion control.

3. The hot water supply apparatus as claimed in claim 1, wherein the hot water supply apparatus further comprises a hot water supply temperature sensor that detects a hot water supply temperature, which is a temperature of the water supplied to a hot water supply terminal at a downstream end of a hot water supply passage connected to a downstream side of the heat exchanger, wherein:

the controller is configured to perform the intermittent combustion control during the hot water supply operation when the condition in which the water supply temperature exceeds the predetermined the upper limit of the water supply temperature is satisfied and, in addition, when a condition in which the hot water supply temperature detected by the hot water temperature sensor is a predetermined temperature or higher, which is higher than the upper limit of the water supply temperature and is lower than a hot water supply set temperature, and in which a required combustion amount necessary to make the hot water supply temperature the hot water supply set temperature is a predetermined value or less is satisfied.

4. The hot water supply apparatus as claimed in claim 1, wherein the controller is configured to perform the intermittent control during the hot water operation when the condition in which the water supply temperature exceeds the upper limit of the water supply temperature is satisfied, and, in addition, when a condition in which a predetermined time elapses from start of the hot water supply operation is satisfied.

5. The hot water supply apparatus as claimed in claim 1, wherein the hot water supply apparatus further comprises a premixing apparatus which mixes a fuel gas with air for the combustion and supplies an air-fuel mixture to the burner through the combustion fan, wherein the premixing apparatus comprises an air supply passage of an upstream side of the combustion fan, a gas supply passage which supplies the fuel gas and a downstream end of which is connected to a gas suction portion provided with the air supply passage, a master valve, a zero governor regulating a secondary gas pressure to an atmospheric pressure, and a variable throttle valve, which are sequentially interposed into the gas supply passage from an upstream side, and a butterfly valve interposed into a portion of the air supply passage of an upstream side of the gas suction portion, and wherein the controller is configured to perform a control in which a combustion capacity is switched to a small capacity by making an opening degree of the butterfly valve a predetermined small capacity opening degree of a closed side, and by making an opening degree of the variable throttle valve a predetermined small capacity opening degree, a control in which the combustion capacity is switched to a large capacity by making the opening degree of the butterfly valve a predetermined large capacity opening degree of an opened side, and by making an the opening degree of the variable throttle valve a predetermined large capacity opening degree larger than the small capacity opening degree, and the intermittent control in a state where the combustion capacity has been switched to the small capacity, wherein:

during the combustion stoppage in the intermittent control, the butterfly valve is made to the large capacity opening degree and the combustion fan is made to operate.

* * * * *